US007543953B2

(12) United States Patent
Chapman

(10) Patent No.: US 7,543,953 B2
(45) Date of Patent: Jun. 9, 2009

(54) LED FLASHLIGHT WITH SWITCH ACTUATED BY TURNING A LENS TUBE

(75) Inventor: Leonard T. Chapman, North Hollywood, CA (US)

(73) Assignee: Chapman/Leonard Enterprises, Inc., North Hollywood, CA (US)

( * ) Notice: Subject to any disclaimer, the term of this patent is extended or adjusted under 35 U.S.C. 154(b) by 99 days.

(21) Appl. No.: 11/737,552

(22) Filed: Apr. 19, 2007

(65) Prior Publication Data

US 2007/0189005 A1 Aug. 16, 2007

Related U.S. Application Data

(63) Continuation-in-part of application No. 11/379,875, filed on Apr. 24, 2006, now Pat. No. 7,396,141, which is a continuation-in-part of application No. 11/016,041, filed on Dec. 16, 2004, now Pat. No. 7,152,995, which is a continuation-in-part of application No. 10/922,813, filed on Aug. 19, 2004, now Pat. No. 7,083,299, which is a continuation-in-part of application No. 10/644,392, filed on Aug. 19, 2003, now abandoned, which is a continuation-in-part of application No. 10/397,766, filed on Mar. 25, 2003, now Pat. No. 7,147,343.

(51) Int. Cl.
*F21L 4/04* (2006.01)

(52) U.S. Cl. ..... 362/205; 362/800

(58) Field of Classification Search ..... 362/196–208, 362/800
See application file for complete search history.

(56) References Cited

U.S. PATENT DOCUMENTS 4,823,242 A * 4/1989 Maglica et al. ..... 362/187
5,871,272 A * 2/1999 Sharrah et al. ..... 362/184
5,904,414 A * 5/1999 Monteleone et al. ..... 362/205

* cited by examiner

*Primary Examiner*—Sandra L O'Shea
*Assistant Examiner*—Jason Moon Han
(74) *Attorney, Agent, or Firm*—Kenneth H. Ohriner; Perkins Coie LLP

(57) ABSTRACT

A flashlight includes a first or top section attached to a second or base section. The top section has one or more elements that are axially moveable relative to the base section, for focusing light. This movement may be achieved, for example, by having the top and base sections joined via screw threads, and by rotating one section relative to the other. One or more lenses are supported in the top section. An LED or other light source is supported on a base or heat sink on the base section. As the sections move relative to each other, a switch is actuated turning the LED on, and the lens moves relative to the LED, focusing light from the LED. The base section has a housing forming a battery compartment. Electronic components are encapsulated in a potting compound, such as thermally conductive epoxy, to improve heat transfer from the components, and to better resist environmental affects.

16 Claims, 10 Drawing Sheets

FIG. 19
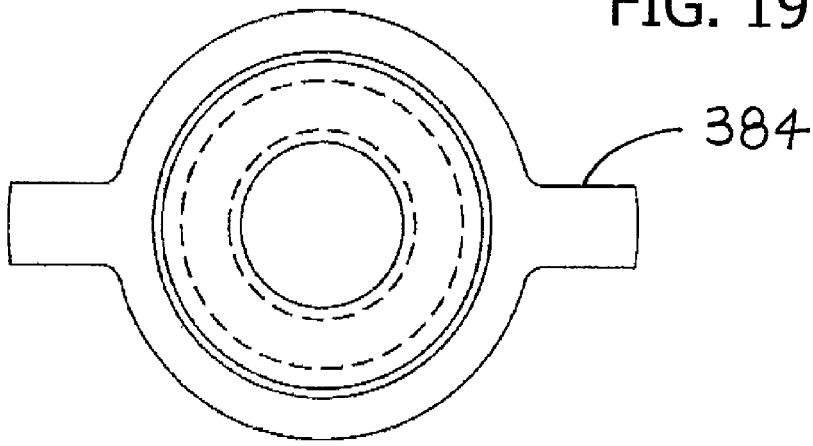
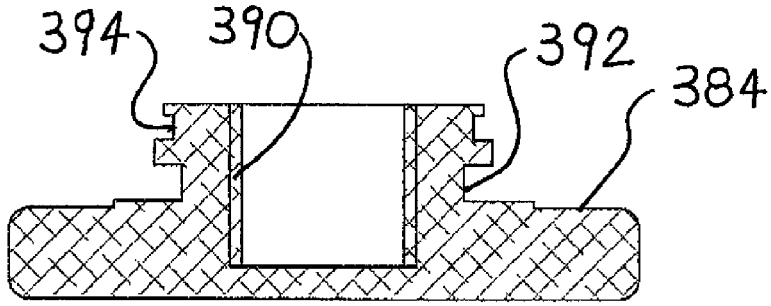
FIG. 20

LED FLASHLIGHT WITH SWITCH ACTUATED BY TURNING A LENS TUBE

PRIORITY CLAIM

This application is a Continuation-in-Part of U.S. patent application Ser. No. 11/379,875, filed Apr. 24, 2006, now U.S. Pat. No. 7,396,141, which is a Continuation-in-Part of U.S. patent application Ser. No. 11/016,041, filed Dec. 16, 2004, now U.S. Pat. No. 7,152,995, which is a Continuation-in-Part of U.S. patent application Ser. No. 10/922,813, filed Aug. 19, 2004, now U.S. Pat. No. 7,083,299, which is a Continuation-In-Part of U.S. patent application Ser. No. 10/644,392, filed Aug. 19, 2003, now abandoned, which is a Continuation-In-Part of U.S. patent application Ser. No. 10/397,766, filed Mar. 25, 2003, now U.S. Pat. No. 7,147,343. Priority to each of these applications is claimed under 35 U.S.C. § 120. These applications are also incorporated herein by reference.

SUMMARY

A flashlight includes a first or top section attached to or joined with a second or base section. The top section has one or more elements that are axially moveable relative to the base section, for focusing light. This movement may be achieved, for example, by having the top and base sections joined via screw threads, and by rotating one section relative to the other. One or more lenses are supported in the top section. An LED or other light source is supported on the base section. As the sections move relative to each other, the lens moves relative to the LED, focusing light from the LED. Electronic components may be entirely encapsulated to improve heat transfer away from the components, and to better resist shock and vibration, or other adverse environmental effects.

The base section has a housing forming a battery compartment for holding at least one battery. Contacts may be provided on the base section for charging the battery, without removing the battery from the flashlight.

Other features and advantages will become apparent from the following detailed description and drawings, which show one embodiment of the flashlight. However, the following detailed description and drawings are intended to describe one example of the flashlight, and they are not intended to describe the only example, or to be limits on the scope of the invention.

BRIEF DESCRIPTION OF THE DRAWINGS

FIG. 19 is a top view of the cap nut shown in FIG. 16.

FIG. 20 is a section view of the cap nut shown in FIG. 19.

DETAILED DESCRIPTION OF THE DRAWINGS

Figure 1:
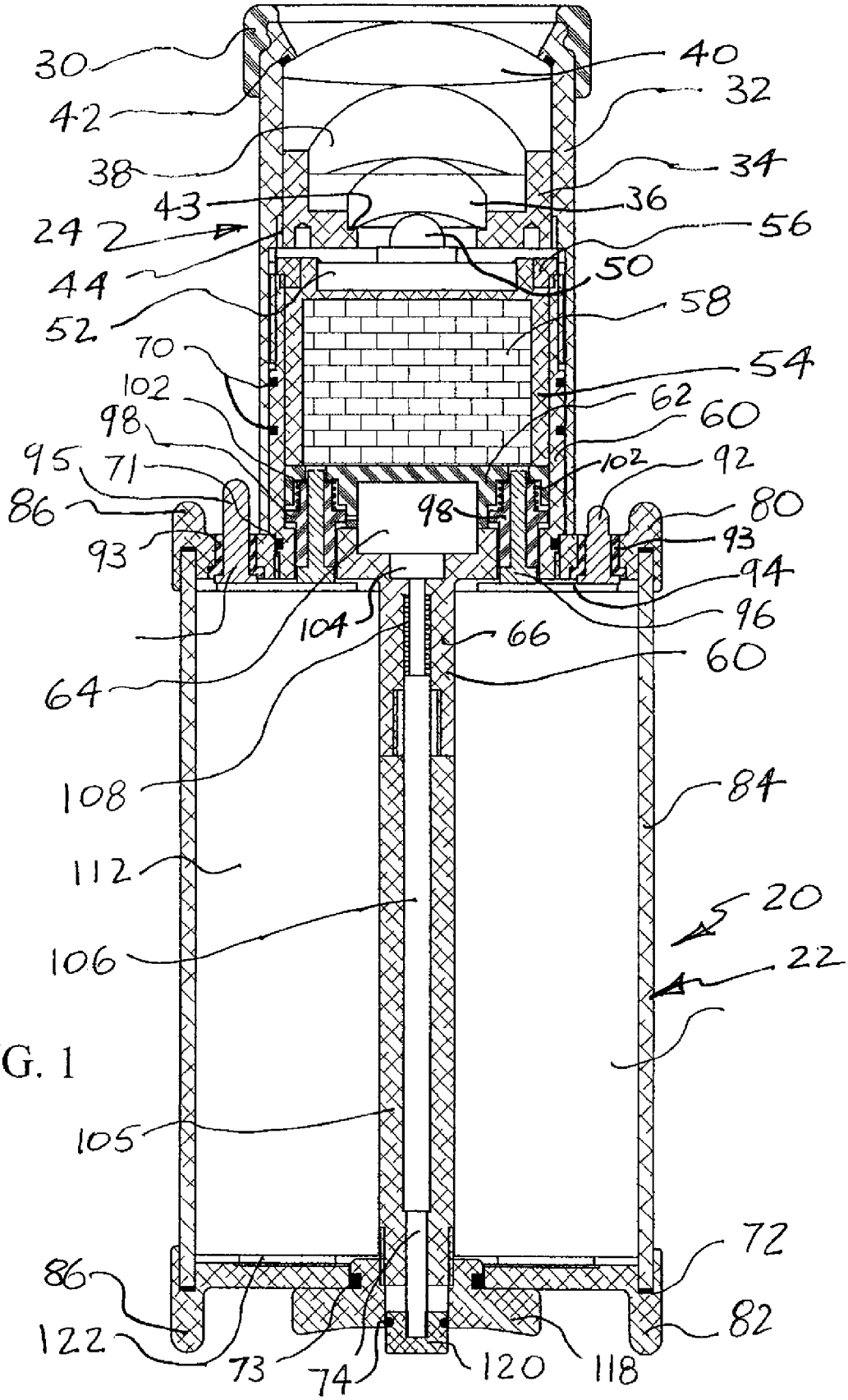
FIG. 1 is a section view of the present flashlight.
Figure 3:
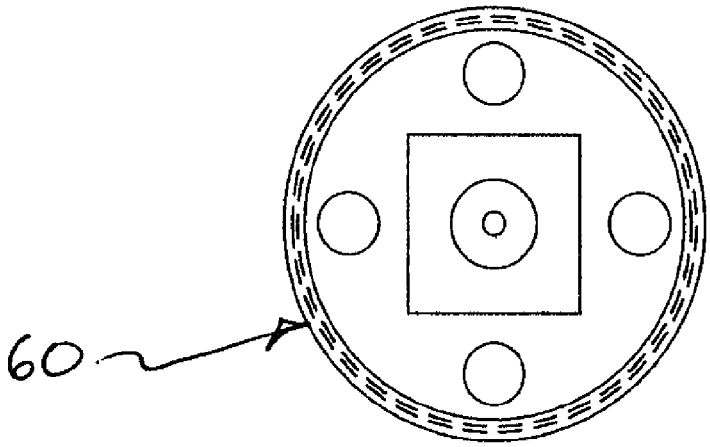
FIG. 3 is a top view.
Figure 2:
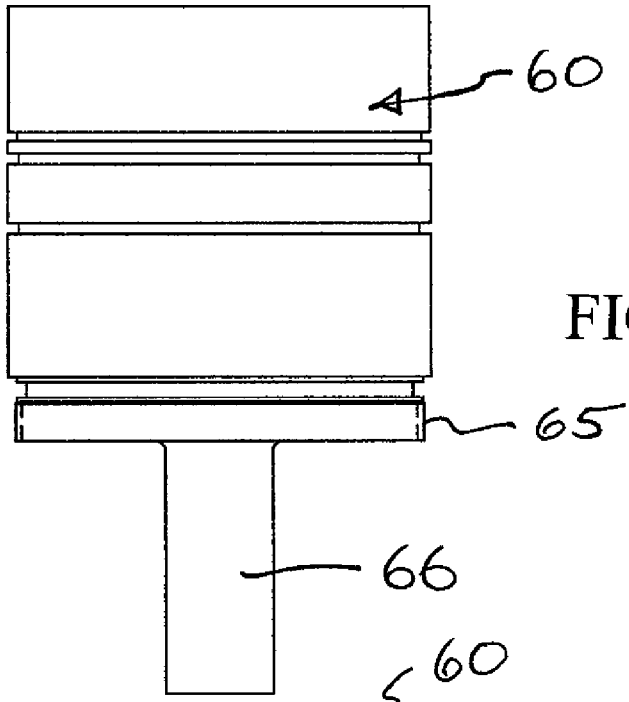
FIG. 2 is a side view of the base tube 60 shown in FIG. 1.
Figure 4:
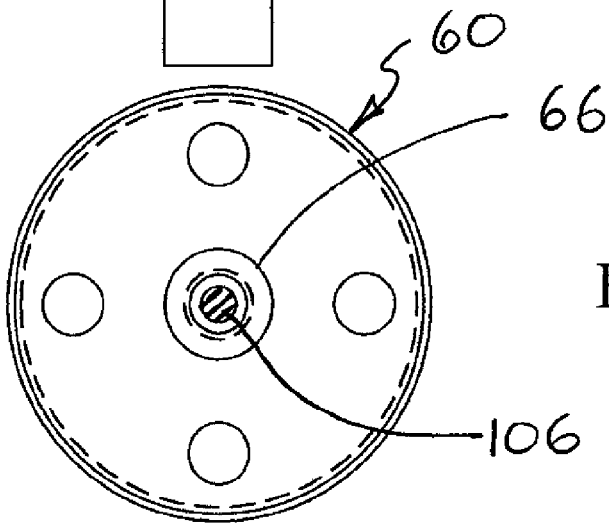
FIG. 4 is a bottom view of the cup shown in FIG. 2.

Turning now to FIG. 1, a flashlight 20 has a body or base section, generally designated 22, and a front or top section, generally designated 24. The top section 24 includes a front cap 30 which can be snapped onto a lens tube 32. One or more lenses may be provided in the flashlight 20. In the design shown, a first lens 36 and a second lens 38 are supported in a lens ring 34 joined to the lens tube via screw threads 44. A third lens 40 is supported near the top or front opening of the lens tube 32. An O-ring 42 seals the perimeter of the lens 40 to the lens tube 32. Another O-ring 43 or similar resilient element is provided between the first lens 36 and the lens ring 34. The O-rings 42 and 43 hold the lenses against each other, and can also absorb shock impact if the flashlight is dropped.

A light source, such as an LED 50 is aligned on axis with one or more of lenses 36, 38, and 40, if used. Various types of LEDs may be used. The LED 50 shown in FIG. 1 is a five-watt white LED. The LED 50 may be attached to an LED holder 52, to facilitate making electrical connections and to conduct heat away from the LED 50. A circuit module 58 may be provided within the front section 24. The circuit module 58 may be contained within a circuit module tube 54. The circuit module may include circuitry for regulating current to the LED, or for providing other functions, such as dimming, flashing, stay-bright current regulation, battery charge/time remaining, charging status, etc.

Figure 6:
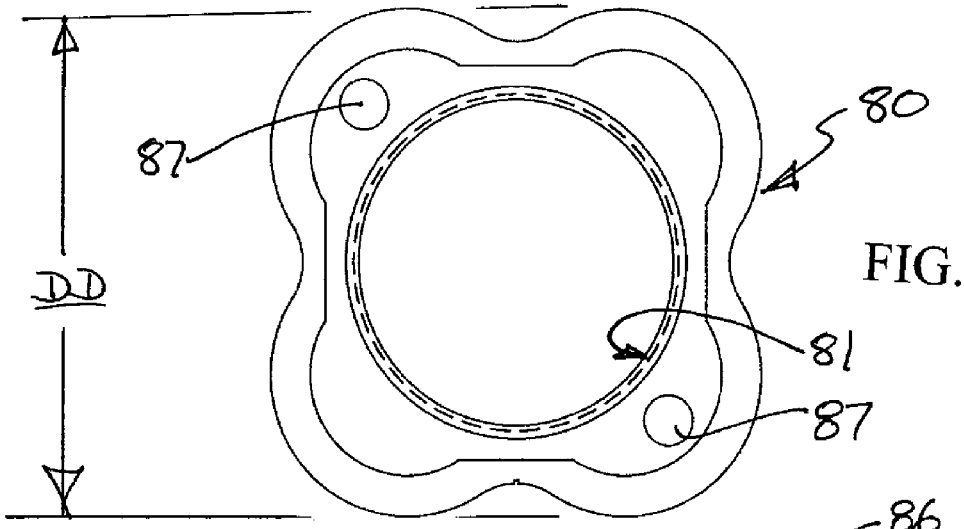
FIG. 6 is a top view.
Figure 5:
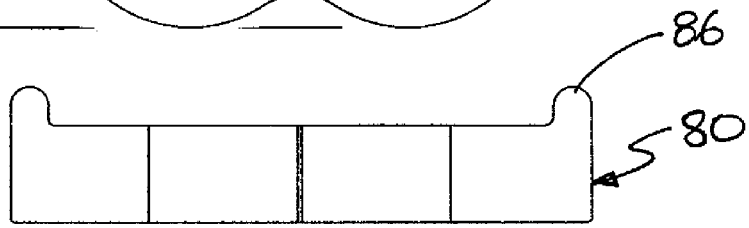
FIG. 5 is a side view of the base cap shown in FIG. 1.
Figure 7:
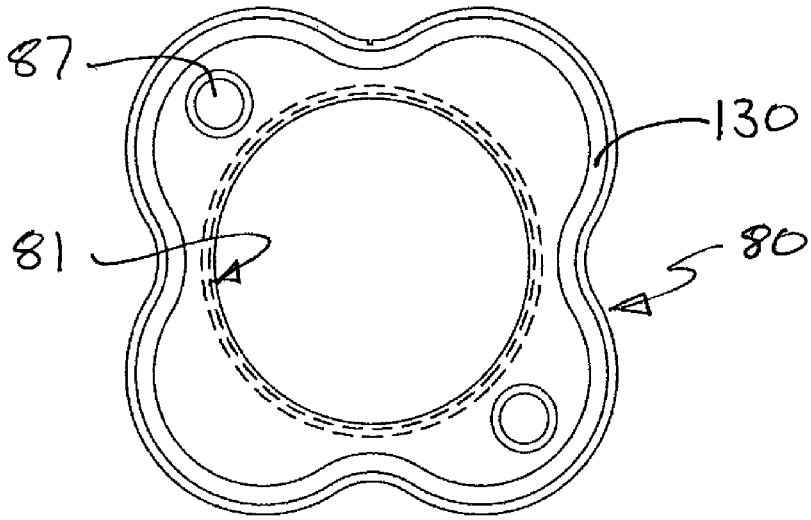
FIG. 7 is a bottom view of the base cap 80 shown in FIG. 5.

Referring now to FIGS. 1-4, a base tube 60 has a cylindrical upper section positioned between the circuit module tube 54 and the lower end of the lens tube 32. A smaller diameter neck 66 of the base tube 60 extends into the base section 22. Screw threads 65 on the base tube 60 engage with corresponding threads 81 on an inside surface of a base cap 80, as shown in FIGS. 5-7. The base tube 60 is accordingly securely attached to the base cap 80. A latching switch 64 is secured between the lower end of the base tube 60 and a switch holder 62. The circuit module 58 and the module tube 54 are clamped down on top of the switch holder 62 via a retainer 56 engaging threads on the inside upper end of the base tube 60.

Referring to FIG. 1, four lithium batteries 112 are connected in series via linking or crossover conducting elements at the top and bottom ends of the battery compartment. A cathode charging pin 92 connects to the cathode contact of the first battery in series and an anode charging pin 95 connects to the anode contact of the last (here the fourth) battery in series. Module contacts 96 are biased downwardly onto these battery contacts as well by springs 102 acting on contact guides 98 surrounding the contacts 96. Battery voltage, in this case 14.4V, is supplied from the batteries 112 to the circuit module 58 via the module contacts 96 and wire leads. Charging pins 92 and 95 are supported on the base cap 80 via pin guides 93. Seals or O-rings 70 and 71 may be used to seal the base tube 60 against the lens tube 32 and against the base cap 80.

Figure 10:
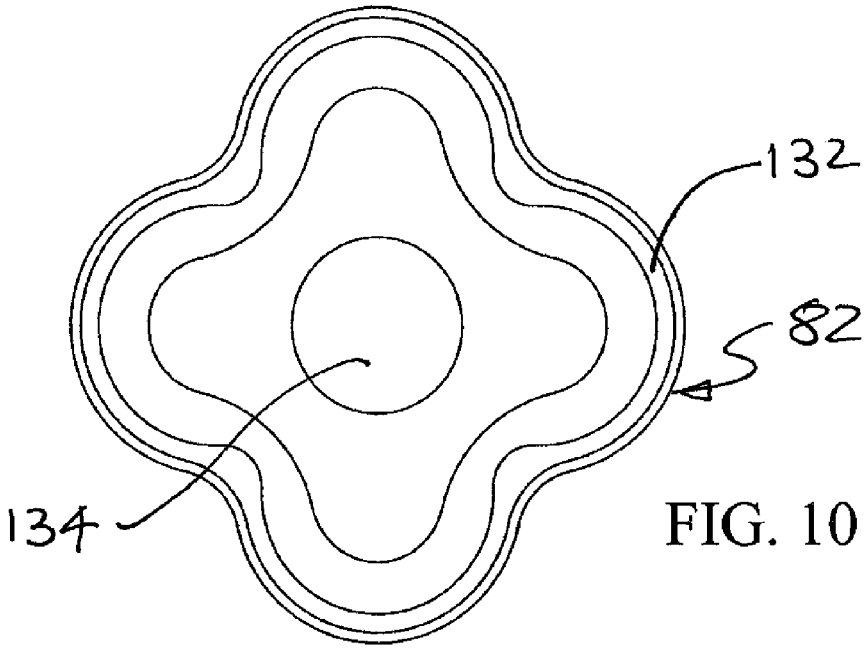
FIG. 10 is a top view of the end cap 82 shown in FIG. 1.
Figure 12:
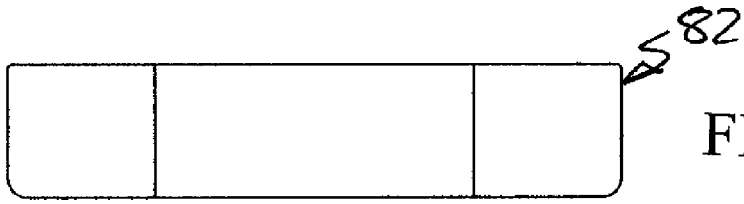
FIG. 12 is a side view, of the end cap shown in FIG. 10.
Figure 11:
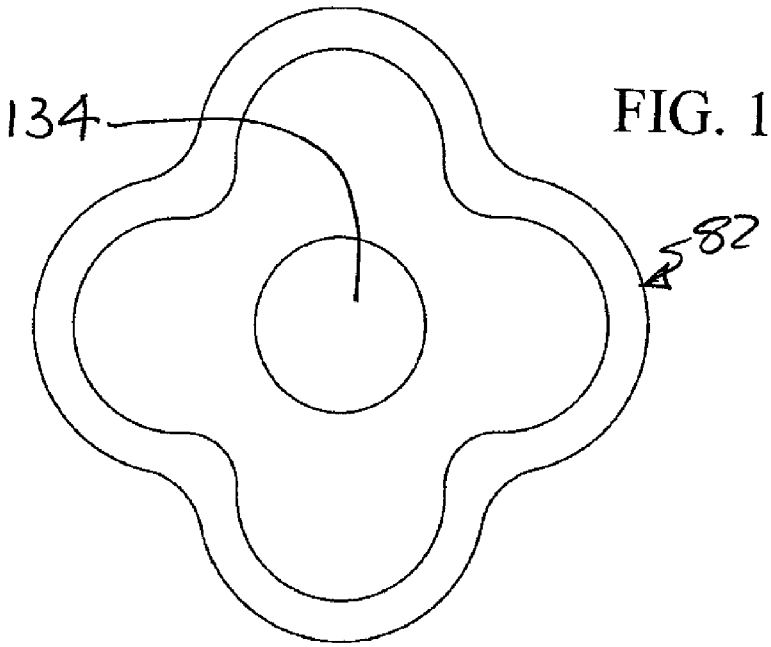
FIG. 11 is a bottom view.
Figure 13:
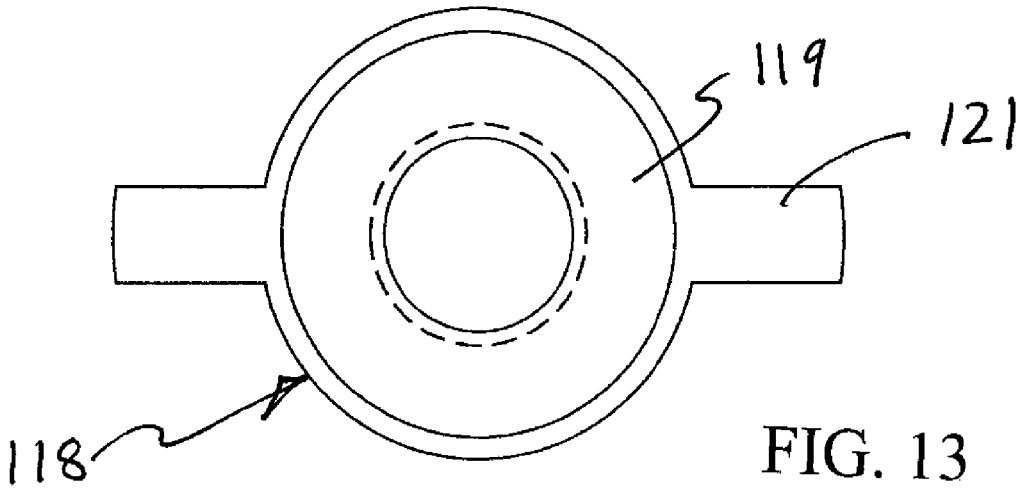
FIG. 13 is a bottom view of the cap nut 118 shown in FIG. 1.
Figure 14:
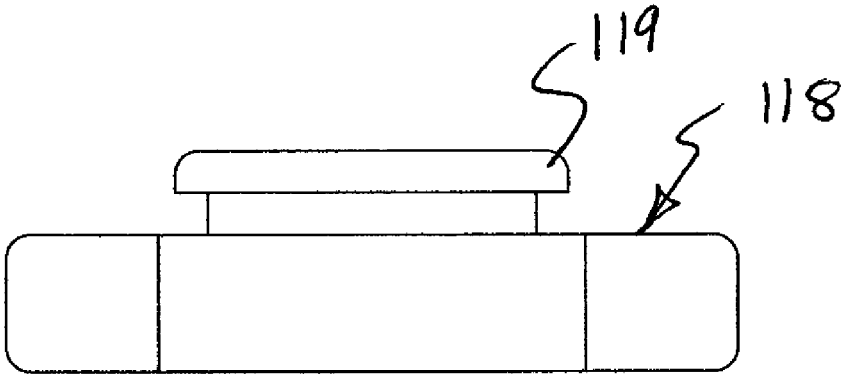
FIG. 14 is a side view of the cap nut 118 shown in FIG. 13.

An end cap 82, as shown in FIGS. 10-12, is attached at the back or bottom end of the base section 22. In the design shown, the base housing 84 is provided as a thin wall metal or plastic shell having multiple lobes 88. The front or top end of the housing 84 is positioned and sealed within a groove 130 in the base cap 80, shown in FIG. 7. Similarly, the lower or bottom end of the base housing 84 is positioned and sealed within a groove 132 in the end cap 82, shown in FIG. 10. An upper or front end of a central standoff 105 is threaded into the neck section 66 of the base tube 60. The standoff 105 extends substantially entirely through the housing 84. A cap nut 118 located within a central opening 134 in the end cap 82 is screwed onto the back or lower end of the standoff 105, thereby clamping the end cap 82 and base cap 80 to the ends of the housing 84.

A push rod 106 extends through a bore in the standoff 105 to engage a plunger 104 of the switch 64. A return spring 108 exerts an outward or downward (return) force on the push rod 106. A counter bore in the standoff 105 limits outward or downward movement of the push rod 106. A push button 120 is attached to the outer or lower end of the push rod 106. An O-ring or seal element 74 seals the push button 120 against the bore in the cap nut 118, while also allowing in/out sliding movement of the push button.

The cap nut 118 may be sealed against the end cap 82 with an O-ring 73. Similarly, O-rings or other seal elements 72 may be provided in the grooves 130 and 132 in the base cap 80 and end cap 82. Adhesives may optionally also be used in addition to, or in place of, sealing elements.

Figure 8:
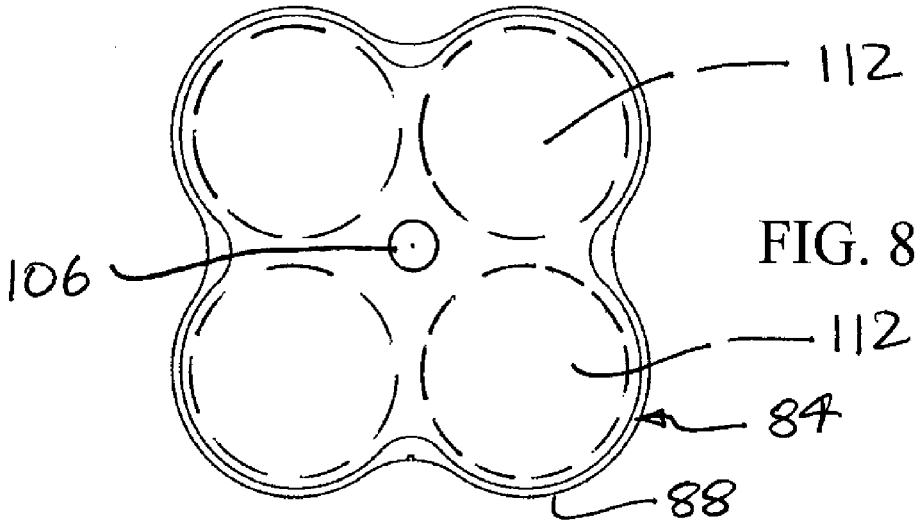
FIG. 8 is a top view of the base housing 84 shown in FIG. 1.
Figure 9:
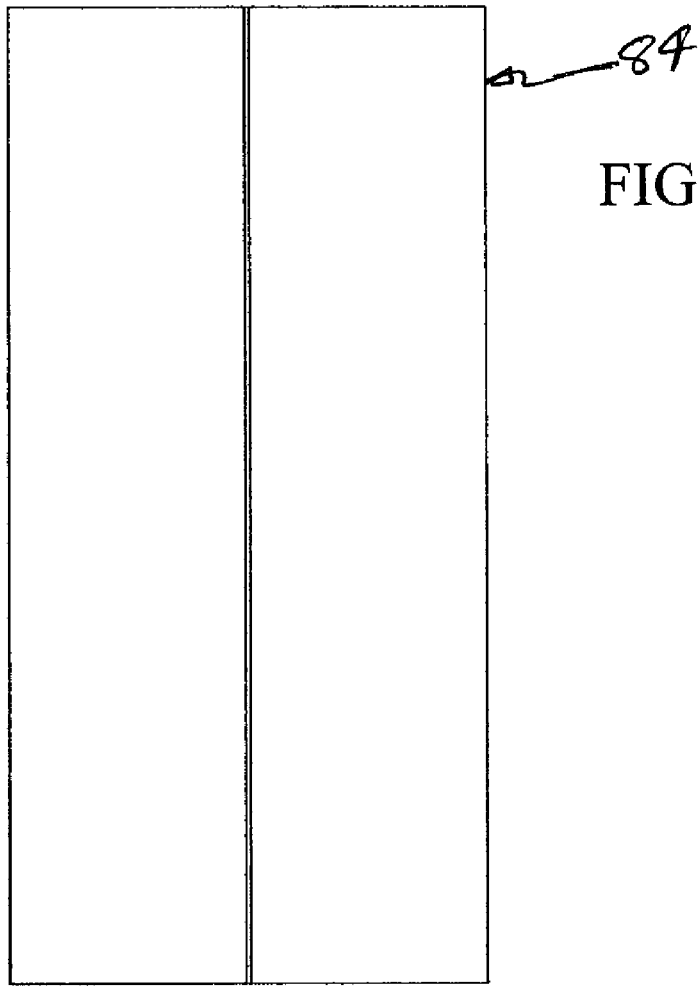
FIG. 9 is a side view of the base housing shown in FIG. 8.

The base cap 80 and end cap 82 may include a raised shoulder 86 projecting outwardly from the base section 22. The raised shoulder 86 helps to resist impact damage to the flashlight 20. Similarly, the front cap 30 on the lens tube 32 helps to prevent the lens and the top section 24 of the flashlight 20 from impact damage. The front cap 30 may be made of a resilient material, such as rubber. As shown in FIG. 1, the front cap 30 may be secured onto the lens tube 32 with a tongue in groove design, allowing the front cap 30 to be quickly and easily installed and removed. The base section has a larger diameter or width than the top section. For example, the lens tube in the design shown has a diameter of about 1¼ inches while the dimension D (referred to here as a diameter, although measured across the flats in FIG. 6) may be about 1½ inches. In this specific design, the flashlight may be about 5¼ inches long. The lobes of the base housing conform to the diameter of the batteries. Accordingly, as shown in FIG. 8, four cylindrical batteries may be contained in a very short and compact space, with very little wasted empty space between them.

In use, the flashlight 20 is advantageously provided with high output and/or long lasting batteries 112, providing up to 8 hours of continuous use. The batteries may be rechargeable lithium batteries 112. The flashlight 20 is turned on by pushing the button 120. This moves the push rod 106 up, depressing the switch plunger 104, and turning the latching switch 64 into an on position. The circuit module includes a DC to DC converter which converts 14.8 battery voltage to about 5 volts for driving the LED. When the switch 64 is closed, the circuit module 58 provides 5 VDC to the LED 50, causing the LED to emit light. Light emitted from the LED 50 is focused by one or more lenses 36, 38, and 40, providing a bright and substantially uniform beam of light. The light may be focused by turning the lens tube 32. As the lens tube 32 turns, it moves axially via the thread engagement between the lens tube 32 and the base tube 60, which is fixed in place on the base section 22. As the lens tube 32 moves axially, the distance between the lens 36 and the LED 50 changes, allowing light from the LED 50 to be focused. The circuit module may optionally also maintain supply of about 5 VDC to the LED, even as battery voltage drops. This allows the flashlight to continue to provide bright light, until the batteries are fully drained. The flashlight is switched off by again pushing the button 120, causing the switch 64 to toggle off.

Heat from the LED 50 is conducted away through the LED holder 52, the module tube 54, the base tube 60, the lens tube 32, and the battery housing 84. These elements may be made of a thermally conductive material, such as aluminum.

The lobes 88 on the base section 22 provide an ergonomic gripping surface for handling the flashlight 20. The flashlight is compact and relatively short, with a low center of gravity. This makes the flashlight stable. For example, the flashlight may be set on its base, i.e., on end plate 82 or on its side, and it will generally remain in place. When used in an upright position, a lampshade/diffuser accessory may be attached to the top end, allowing the flashlight to act as a table lamp.

The base cap 80 and the end cap 82, as well as the base housing 84, may be made of metal, e.g., aluminum formed via die casting or other process, or alternatively of a high strength plastic, to better resist impact and rough handling. The base housing 84, for example, may be formed from an aluminum extrusion. A rubber sleeve accessory may be fit over the base housing 84 to protect the base section from impact, abrasion, etc. The rubber sleeve may have through holes for better heat dissipation.

The seals or O-rings 42 and 70-73 provide a substantially water proof enclosure. Accordingly, the flashlight 20 may be used in wet conditions, or even submerged, while continuing to operate. The pin guides 93 seal around the charging pins 92 and 95.

Figure 15:
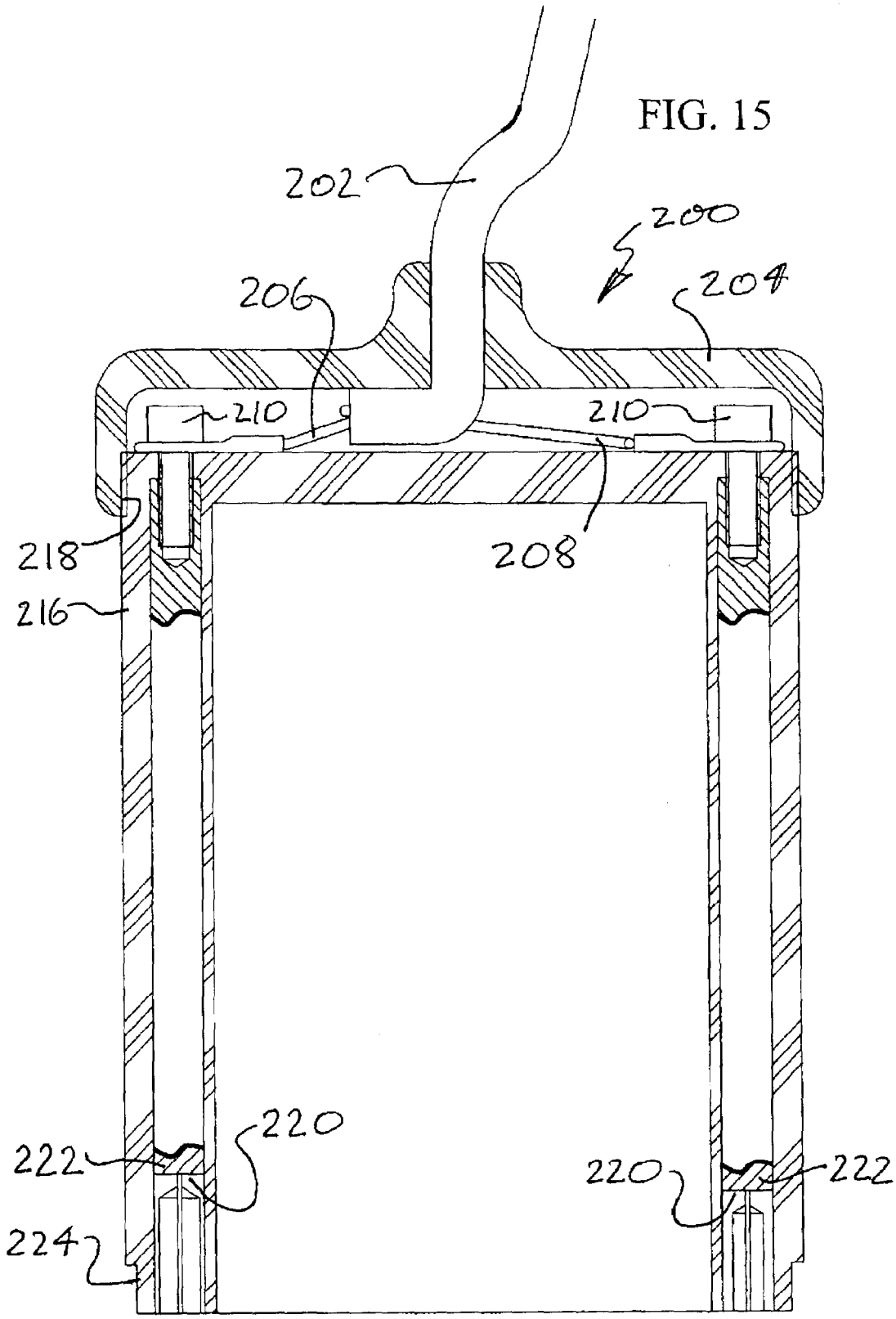
FIG. 15 is a section view of a battery charger for use with the flashlight shown in FIG. 1.

The batteries 112 may be charged without removing them from the flashlight 20. Referring to FIG. 15, a charger 200 is adapted to make electrical contact with the charging pins 92 and 95, to charge the batteries 112.

The charger 200 includes a power lead 202 attached to contact points 222 positioned within contact bores 220 in the cylindrical sidewalls of the charger housing 216. Wire leads 206 and 208 from the power wire 202 are attached to the contact pins 222 via cap screws 210. A top cap 204 is threaded onto the upper end of the charger housing 216. The power line 202 connects to a battery charger which provides for rapid charging of the batteries 112, as is well known in the field. Since the battery charger can operate off of wall current, or from e.g., a 12 volt vehicle battery, the flashlight may be charged from various sources.

To charge the batteries 112, without removing them from the flashlight 20, the front cap 30 is removed from the front section 24 of the flashlight 20. The charger housing 216 is moved down over the front section 24, with the contact pins 222 of the charger 200 making physical and electrical contact with the charging pins 92 and 95. The contact pins 222 have split lower ends that slide over and onto the charging pins 92 and 95. The charging pin 95 is larger and longer than the charging pin 92, to prevent connecting the charger 200 with reverse polarity. A shoulder 224 at the bottom end of the charger housing 216 comes to a stop against the shoulder ring 86 on the base cap 80. Current flows through the charger 200, charging pins 92 and 95, to the batteries 112, so that the batteries are charged. Upon completion of charging, the charger 200 is removed by pulling it off of the flashlight 20. The flashlight 20 is then ready for renewed use. The charging pin 92 is shielded by the raised shoulder 86 of the base cap 80, to better avoid inadvertent contact with the charging pin 92.

To change the batteries 112, the cap nut 118 is unscrewed from the standoff 105 and removed. This opens up the bottom end of the base housing 84, allowing the batteries to be removed and replaced. The flashlight 20 may be used with standard (disposable) batteries, or with rechargeable batteries. When rechargeable batteries are used, replacing the batteries will seldom be needed. When non-rechargeable batteries are used, they may be quickly and easily replaced by unscrewing the cap nut 118 and removing the end cap 82. After the batteries are replaced, the end cap 82 is once again secured to the housing 84 via the cap nut 118, and the battery compartment is again sealed by the seal element for O-ring 72 contained in the groove in the end cap 82.

Figure 16:
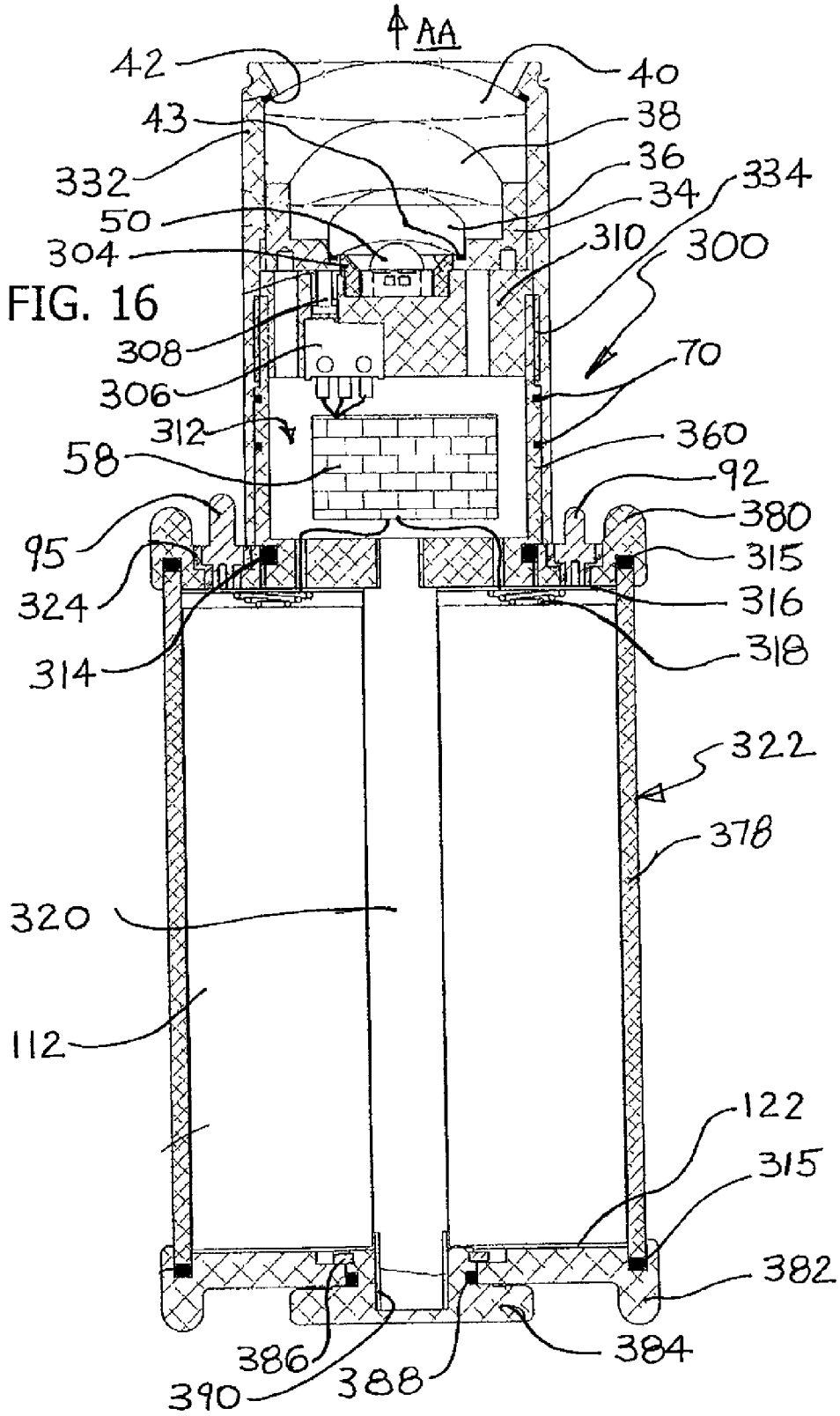
FIG. 16 is a section view of a second embodiment.

FIG. 16 shows a second embodiment which is generally similar to the first embodiment 20 shown in FIGS. 1-15, with the following differences. A reflector 304 is positioned around the LED 50 in or on an LED base or heat sink 310. They LED 50 may be adhered to the base 310 with a thermally conductive epoxy adhesive. The reflector 304, if used, may have a parabolic inner surface, to direct more of the light emitted from the LED through the lenses. The reflector may be made of a highly polished metal, and be pressed or threaded into the base 310. The reflector 304 may also be designed to mechanically hold the LED 50 down onto the base 310. In one design, as the reflector is threaded into engagement with the base 310, the reflector clamps down on the LED legs, body or lens, to mechanically hold the LED in place.

A switch 306 may be held in place in or on the base 310. A lens tube 332 is attached to a base tube or cup 360 via screw threads 334. The base tube or cup 360 is attached to a base cap 380 or similar element. The base tube 360 may be provided in the form of a tube, with open ends, or as a tube with one open end and one generally closed end. Turning the lens tube according moves the lenses (here lenses 36, 38 and 40) longitudinally relative to the LED 50. Other numbers and types of lenses may be used.

Referring still to FIG. 16, a pin 308 is biased outwardly from the switch 306 and engages a surface of the lens ring 34. Consequently, the switch 306 may be actuated by turning the lens tube 332. A circuit module 58 may be contained within the base tube 360 and is wired to the switch 306 and to one or more batteries 112. The electrical connections may be achieved via wiring, contact springs 318 connecting to an upper contact plate 316, and a lower contact plate 122.

The base cap 380, a base housing 378 and an end cap 382 form the base section 322 of the flashlight 300. A post 320 is threaded into or is otherwise attached to the base cap 380 and the end cap 382, securing them onto the base housing 378. An O-ring or other seal element 314 seals the base tube 360 to the base cap 380. Similarly, O-rings 315 seal the base cap 380 and the end cap 382 to the base housing 378. Where the base cap 380 is made of electrically conductive metal, the anode pin 92 and the cathode pin 95 are supported in insulating pin guides 324 on the base cap 380. The pin guides can also provide a seal around the pins 92 and 95. As a result, the battery compartment may be sealed.

Figure 17:
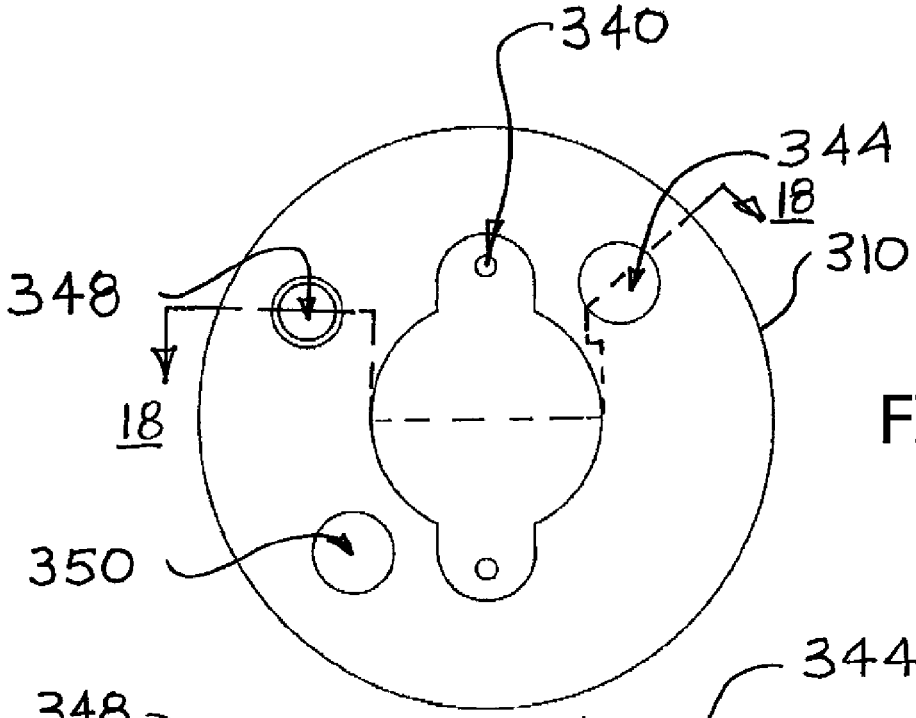
FIG. 17 is a top view of an LED base or heat sink as used in the second embodiment.
Figure 18:
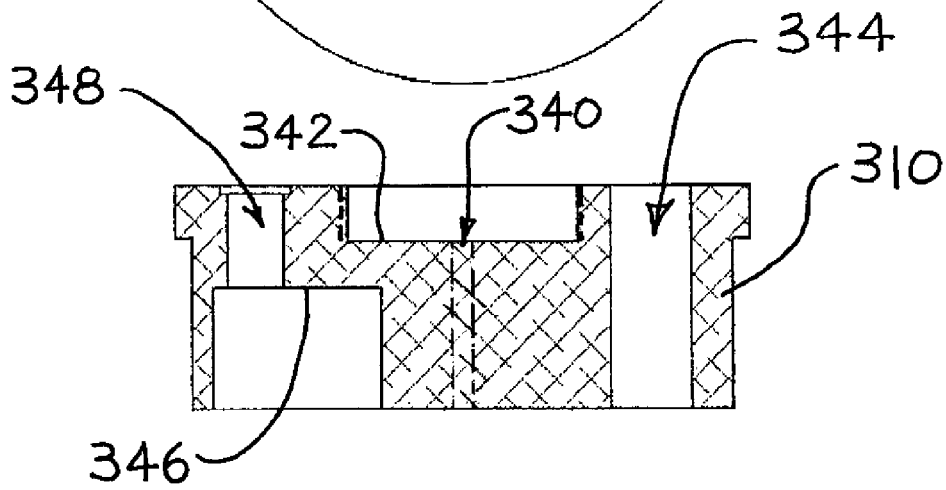
FIG. 18 is a section view taken along line 18-18 of FIG. 17.

Turning to FIGS. 17 and 18, the base 310 may have a reflector seat 342 which the reflector 304 fits or screws into. Holes 340 extend through the base 310 for connecting wire leads from the LED 50 to the switch 306. The switch pin 308 extends through a pin bore 348 in the base 310. The switch may be secured in a switch opening 346 formed in the base 310. The base also may include a potting compound inlet 344 and an outlet 350.

Referring to FIGS. 16-18, during manufacture, the LED and reflector are assembled onto the base 310. The reflector 304 may optionally be made as part of the base, or it may also be omitted. The switch 306 and pin 308 are also assembled onto the base, with the circuit module 58 wired to the LED and to the switch 306. The circuit module is then placed into the base tube 360. The base 310 is then pressed into or onto, or otherwise joined to the base tube 360. A potting compound, such as a thermally conductive and electrically insulating epoxy compound, is then injected into the inlet 344. The compound entirely fills the base tube 360. With the wiring and post openings at the bottom of the base tube 360 temporarily plugged, after the base tube 360 is filled, the compound will begin to flow out of the outlet 350. This provides a visual indication that the base tube 360 is substantially entirely filled with compound. The resulting epoxy filled assembly is highly thermally conductive and rugged, since the internal components are held rigidly in place by the epoxy compound.

The base tube 360 is then attached to the base cap 380 and the base 322, and the wires from the circuit module 58, which extend out of the epoxy filled assembly, are electrically connected to the battery contacts 316 and/or 318, if these steps are not performed earlier in the manufacturing process.

Turning now to FIGS. 16, 19 and 20, a cap nut 384 has an o-ring groove 392 and a retainer groove 394. Internal screw threads on the cap nut 384 engage with the threaded back end of the post 320. As shown in FIG. 16, an o-ring 388 positioned in the o-ring groove 392 seals the cap nut 384 to the end cap 382, while still allowing the cap nut to turn. A retainer or snap ring 386 held within the retainer groove 392 retains the cap nut 384 onto the end cap 382, while still allowing the cap nut to turn, and allowing sufficient longitudinal movement so that the end cap 382 can be threaded onto the back or lower end of the post 320.

The flashlight 300 may be used in the same way as the flashlight 20, with the following differences. The battery compartment formed within the base 322 may be opened by turning the cap nut 384, causing the cap nut to disengage from the post 320. The end cap 382 may then be removed from the base 322. Batteries can then be installed. Generally, rechargeable batteries are used, although the flashlight can also operate with disposable batteries. The cap nut is captive on the end cap 382 via the retainer ring 386. With the batteries installed, the end cap 382 is replaced. Turning the cap nut 384 in the reverse direction once again secures the end cap 382 in place. The o-ring 388 slides relative to the cap nut 384 and/or the end cap 382 as the cap nut 384 is tightened.

The flashlight 300 is operated by turning the lens tube 332. FIG. 1 shows the flashlight 300 in the off position. As the lens tube 322 is turned relative to the base tube, the lens tube (and all components supported on the lens tube) move up, in the direction of the arrow AA in FIG. 16. As the lens ring 34 moves away from the base 310, the switch pin 308 moves out, causing the switch 306 to switch to switch on. This requires only a small amount of movement. Turning the lens tube 332 further allows for focusing light from the LED. The flashlight 300 is turned off by turning the lens tube 332 in the reverse direction.

Heat generated by the LED moves via conduction through the base 308, through the epoxy filled base tube 360, and into the lens tube, base cap and the base housing 378. The lens tube 332, base tube 360, base cap 380 and base housing 378 may be made of a highly thermally conductive material, such as aluminum. Heat from the circuit module 58 follows a similar path through the epoxy material. As a result, these heat generating elements are connected to much larger conducting and convecting surfaces, which provides for efficient cooling of these elements. The flashlight 300 can therefore operate at higher power levels to provide brighter lighting, without overheating these components.

The flashlights 20 and 300 may be designed to hold and use 8 lithium 123 batteries. In alternative designs, other numbers and types of batteries may be used. For example, in a 4 battery design, the base housing 84 may simply be made shorter, while in a 12 battery design, the base housing 84 may be made longer, to adapt to the number of batteries to be used. Larger capacity and larger size batteries may also be used, such as LGDA2E13650-2300 or -2600 mA hour lithium batteries.

Various changes and substitutions may of course be made without departing from the spirit and scope of the invention. The invention, therefore, should not be limited, except to the following claims and their equivalents.

The invention claimed is:

1. A flashlight comprising:

a base section housing forming a battery compartment for holding at least one battery;

a base tube attached to the base section a base cap and an end cap on the base section, with the base tube attached to the base cap;

a lens tube attached to the base tube via screw threads;

at least one lens supported on the lens tube;

a base attached to the base tube;

an LED on the base;

a switch electrically connected to the battery compartment and to the LED, with the switch actuated by turning the lens tube relative to the base tube; and a post having a first end attached to the base cap, and a second threaded end, and with the end cap held onto the post and the base section housing by a cap nut having a sealing element and a retainer retaining the cap nut to the end cap while allowing the cap nut to rotate relative to the end cap.

2. The flashlight of claim 1 further comprising a circuit module in the base tube, and with the switch supported on or in the base.

3. The flashlight of claim 2 with the base tube substantially entirely filled with a potting compound.

4. The flashlight of claim 1 further comprising a reflector attached to the base and surrounding the LED.

5. The flashlight of claim 4 with the reflector holding the LED onto the base.

6. The flashlight of claim 1 further comprising a lens ring within and attached to the lens tube, and with the at least one lens attached to the lens ring.

7. The flashlight of claim 1 with further comprising first and second battery charging pin contacts on the base cap and extending into the battery compartment.

8. The flashlight of claim 7 with the first charging pin contact larger than the second battery pin contact.

9. A flashlight comprising:

a base section housing forming a battery compartment for holding at least one battery, with the base section including a base cap and an end cap;

a base tube attached to the base section and to the base cap;

a potting compound in the base tube;

a post having a first end attached to the base cap, and a second threaded end, and with the end cap held onto the post and the base section housing by a cap nut having a sealing element and a retainer retaining the cap nut to the end cap while allowing the cap nut to rotate relative to the end cap;

a lens tube attached to the base tube via screw threads;

at least one lens supported on the lens tube;

an LED on the base section; and a switch electrically connected to the battery compartment and to the LED, with the switch actuated by turning the lens tube relative to the base tube.

10. The flashlight of claim 9 further comprising a circuit module in the base tube, and with the switch supported on or in the base.

11. The flashlight of claim 9 with the base tube substantially entirely filed with the potting compound.

12. The flashlight of claim 9 further comprising a base cap and an end cap on the base section, and with the base tube attached to the base cap.

13. The flashlight of claim 12 further comprising a post having a first end attached to the base cap, and a second threaded end, and with the end cap held onto the post and the base section housing by a cap nut having a sealing element and a retainer retaking the cap nut to the end cap while allowing the cap nut to rotate relative to the end cap.

14. The flashlight of claim 13 further comprising first and second battery charging pin contacts on the base cap and extending into the battery compartment.

15. The flashlight of claim 9 further comprising a reflector attached to the base and surrounding the LED.

16. The flashlight of claim 9 further comprising a lens ring within and attached to the lens tube, and with the at least one lens attached to the lens ring.

* * * * *